US010724240B2

(12) United States Patent
Brandao et al.

(10) Patent No.: US 10,724,240 B2
(45) Date of Patent: Jul. 28, 2020

(54) INTERLOCKING BUILDING BLOCKS FOR CHANGEABLE MODULAR ASSEMBLIES

(71) Applicants: Miguel Brandao, Cascais (PT); Catarina Brandao, Alcabideche (PT); Artur Brandao, Alcabideche (PT)

(72) Inventors: Miguel Brandao, Cascais (PT); Catarina Brandao, Alcabideche (PT); Artur Brandao, Alcabideche (PT)

(73) Assignee: Miguel Brandao, Cascais (PT)

( * ) Notice: Subject to any disclaimer, the term of this patent is extended or adjusted under 35 U.S.C. 154(b) by 0 days.

(21) Appl. No.: 15/310,532

(22) PCT Filed: Jun. 19, 2015

(86) PCT No.: PCT/IB2015/054609
§ 371 (c)(1),
(2) Date: Nov. 11, 2016

(87) PCT Pub. No.: WO2015/193840
PCT Pub. Date: Dec. 23, 2015

(65) Prior Publication Data

US 2017/0121973 A1 May 4, 2017

(30) Foreign Application Priority Data

Jun. 20, 2014 (PT) ..... 107729

(51) Int. Cl.
*E04C 1/00* (2006.01)
*E04B 2/18* (2006.01)
(Continued)

(52) U.S. Cl.
CPC ..... *E04C 1/00* (2013.01); *A63H 33/084* (2013.01); *E04B 1/343* (2013.01); *E04B 2/18* (2013.01); *E04B 2002/0206* (2013.01); *E04B 2002/0217* (2013.01)

(58) Field of Classification Search
CPC .... E04F 19/02; E04C 1/00; E04C 1/24; E04C 1/34; A63H 33/04; A63H 33/044;
(Continued)

(56) References Cited

U.S. PATENT DOCUMENTS 1,894,605 A * 1/1933 Wright ..... A63H 33/04 446/122
2,319,914 A * 5/1943 Blanding, Jr. ..... A63H 33/04 446/124
(Continued)

FOREIGN PATENT DOCUMENTS

DE 3106676 A1 2/1981
ES 2063599 B1 8/1996
(Continued)

*Primary Examiner* — Jessica L Laux

(57) ABSTRACT

The invention relates to interlocking building blocks for changeable modular assemblies. The set of interlocking building blocks consists of a female block (1) and a set of male blocks (2-5), wherein the female block (1) has rectangular indentations (7) and the male blocks (2-5) fit inside the rectangular indentations (7) of female blocks (1), so that a female block (1) may simultaneously fit in its rectangular indentations (7) two male blocks (2-5), and a male block (2-5) may simultaneously fit inside at least two female blocks (1). In that way, each male block (2-5) simultaneously fills in at least half the rectangular indentations (7) of at least two female blocks (1) and thus fixedly connects said at least two female blocks (1). The set of interlocking building blocks further comprises a terminal block (6) to fill in empty spaces and provide straight edges on the assembly, and a filling block (11) to extend the assembly eight, width or length. The blocks are stackable and vertically stable but reversible and easy-to-handle. No additional tools or materials are required in order to build all kinds of tridimensional structures.

10 Claims, 4 Drawing Sheets

(51) Int. Cl.
*A63H 33/08* (2006.01)
*E04B 1/343* (2006.01)
*E04B 2/02* (2006.01)

(58) Field of Classification Search
CPC ..... A63H 33/06; A63H 33/08; A63H 33/084; A63H 33/086; E04B 1/40; E04B 2/00; E04B 1/343; E04B 2/18; E04B 2002/0206; E04B 2002/02174
See application file for complete search history.

(56) References Cited

U.S. PATENT DOCUMENTS

| | | | | | |
|---|---|---|---|---|---|
| 3,838,535 | A * | 10/1974 | Larws | A63H 33/084 446/124 |
| 4,441,298 | A * | 4/1984 | Limousin | A63H 33/088 52/592.2 |
| 4,473,985 | A | 10/1984 | Hunt | |
| 4,990,116 | A * | 2/1991 | Chen | A63H 33/084 446/124 |
| 6,477,814 | B1 * | 11/2002 | Kadosh | E02D 29/025 405/284 |
| 9,410,314 | B1 * | 8/2016 | Kadosh | E02B 3/108 |
| 2003/0029119 | A1 | 2/2003 | Coleman | |
| 2007/0094989 | A1 | 5/2007 | Scheker | |

FOREIGN PATENT DOCUMENTS

| | | | |
|---|---|---|---|
| WO | 1996009870 | A1 | 4/1996 |
| WO | 97/08402 | A1 | 3/1997 |
| WO | 2008132667 | A1 | 11/2008 |
| WO | 2012153328 | A1 | 11/2012 |

* cited by examiner

INTERLOCKING BUILDING BLOCKS FOR CHANGEABLE MODULAR ASSEMBLIES

FIELD OF THE INVENTION

The present invention relates to the field of building materials, and in particular it concerns stackable and self-supporting blocks or bricks for the construction of changeable modular assemblies, specifically for interior walls and partitions, floors and furniture.

BACKGROUND OF THE INVENTION

Interior design and construction has been experiencing an increasing demand for materials that are easy to handle, versatile and re-usable, perfectly suited to the emerging "do it yourself" trend. A modular construction system that enables structures to be quickly and easily erected, with adequate strength and durability, is in high demand. Several modular systems for building walls or furniture have thus been created, none of the existing techniques nevertheless allowing for an easy-to-lock changeable modular assembly combined with an interlocking system which guarantees the stability of the modular structure.

The U.S. Pat. No. 4,473,985 refers to a building block which has an inner and an outer wall defining a cavity there between. The walls at the top each have a longitudinal projection extending along an inner portion which in a building locates the blocks by being positioned in the lower horizontal channel. The block has two end portions which are either both a female recess or a male protrusion so that the block can be reversed if necessary. A building is formed by using a plurality of double-male and double-female blocks and interlocking them together. Though male-female connections may be established, adjacent blocks cannot be simultaneously interlocked both vertically and horizontally, like the building blocks of the invention.

The patent US2007094989 describes an improved system of interlocking modular construction blocks, the system comprising a standard interlocking modular block comprising an elongated rectangular block body having a top elongated protrusion along a top center of the length of the rectangular block, the ridge having a trapezoidal cross-section tapering to a top edge and the rectangular block body having a bottom longitudinal trapezoidal slot along the length of the rectangular block in a center of a bottom edge, the trapezoidal slot wider along the bottom edge so that it can mate with a top elongated protrusion of another standard interlocking modular block to interlock the standard interlocking modular blocks with one on top of the other, the top elongated protrusion being shorter than the depth of the bottom trapezoidal slot so that a space between a top of the elongated protrusion and a top inner surface of the trapezoidal slot forms a passageway for conduits and wiring. The system also comprises a series of interlocking modular blocks, both T-shaped or L-shaped, for mating with at least one of the standard interlocking modular blocks, each of the interlocking modular blocks of the series comprising a rectangular block body having-the same overall dimensions as the standard interlocking modular block and a similar size trapezoidal slot along at least a portion of a center of a bottom edge for mating with at least a portion of a top elongated protrusion of a standard interlocking modular block to interlock therewith. Though male-female connections may be established, and T-shaped and L-shaped pieces allow different spatial configurations, adjacent blocks cannot be simultaneously interlocked both vertically and horizontally, like the building blocks of the invention whose different male blocks allow interlocking female blocks along four different perpendicular directions, both vertically and horizontally. Therefore, the cohesion and steadiness of the built structures cannot be guaranteed in all axes, unlike the building system of the invention.

The patent WO9708402 refers to a set of structural elements meant for obtaining a self-supported module for constructions of varied sizes and configurations, in a modulated system. The set is composed of a modulated element under the form of a regulated polyhedron, for example a cube, serving with the forming of the corner and field poles; a multifunctional male-female element derived from the said cubic element and having the role of bricks and a lintel with plugs for fixing in the brickwork of the window and door frames. All the three mentioned building parts, presenting guiding, joining, pushing and adherence means according to a labyrinth route of plane surfaces. Even though the building blocks can be interconnected, they are not self supported and cannot be interlocked on their own like the system of the present invention. The stability and reinforcement of the built structures require fixing means (vertical and horizontal bars piercing the building blocks), which are not compatible with the reuse of the building blocks made of a lightweight and easy-to-handle material, like cork-based material, and also turns the building of the structure more difficult and time consuming.

The patent US2003029119 refers to a modular construction block system for use in e.g. landscaping wall, with raised ribs located adjacent to top wall to surround the outer cylinders of block, and aperture formed on the top wall of the block. The end and sidewalls of the interconnecting and stackable blocks are connected to a top wall to define a blind bore to receive the inner cylinders. The outer cylinders set adjacent to the top wall, mate with the inner cylinders if the blocks are coupled. Apertures are formed to the top wall, and raised ribs are located adjacent on the top wall to surround the outer cylinders. The system improves stability of an erected structure since raised ribs of one block are in contact with other blocks when connecting.

It enables simple and quick construction of a wall structure, with enhanced wall strength characteristics, using light weight components. But even though this system ensures some vertical resistance, because it relies on fitting of inner and outer cylinders whose volume is considerably smaller than the volume of the stacked blocks, it does not prevent the tendency to lose verticality with increased height.

The patent WO2008132667 refers to a reversible self-supporting module for constructing lighting walls which has a rectangular rectangular-shaped unitary block body with two opposite faces that delimit an internal cavity. The self-supporting module is used for constructing lighting walls, and can also be used to perform finishing of upper portion of wall such as counter walls, tank walls, dividing walls. It reduces required construction time since reference projections ensure easy and accurate positioning and also ensure resistance against horizontal stress. But even though this system ensures resistance against horizontal stress and some vertical resistance due to the interconnectability of the modules, because it relies on fitting of protrusions whose volume is considerably smaller than the volume of the stacked blocks does not prevent the tendency to lose verticality with increased height.

The patent WO9609870 refers to an easy separation stackable block toy system, which has spacers underside to space stacked blocks apart and provide peripheral gripping edge. Each stacking block has a body part with coupling knobs on its upper side. The knobs are spaced at a mutual uniform modular distance. The bottom of each stacking block body has complementary coupling elements to be coupled with the knobs of another block. The bottom area of each stacking block has one or more spacers. The spacers are configured so that when two stacking blocks are stacked one on top of the other, the block body parts will be spaced apart along their entire periphery. Blocks in this modular toy system can be simply separated, in particular by children under 2 or 3 years of age. Though this system is light weight and quite easy to use, it does also not guarantee vertical stability with increased height.

The patent WO2012153328 refers to building blocks for mortar-free construction. The invention discloses devices and methods for using building blocks for construction that does not require mortar, internal columns or additional internal or external finishing. A building block includes joining elements for attaching blocks from top to bottom as well as from side to side.

Additionally, blocks have internal and external finishes that are complete. Thus, after construction of a structure, there is no additional need to paint, hang wallpaper or otherwise treat the outer and inner walls of the final structure. However, the locking system doesn't also guarantee vertical stability with increased height.

The patent DE3106676 refers to a roof or facade insulation panel which has interlocking shaped pieces facilitating the adaption to varying spacings. The insulating panel, of any thickness, made of insulating material, allows insulation in roofs and external wall facings. Two or preferably three shaped pieces are formed for inserting into each other, or for toothed interlocking. The panel can have a structured sheet metal piece on the underside, serving also for its attachment.

This permits ready adaptation to different spacings, between rafters or structural parts of facade supports, and eliminates associated difficult and dusty overhead work. Even though this modular panel has interlocking shaped pieces, it is not vertically stable on its own, and the provided pieces are not meant to be re-used in a changeable modular assembly. And even if the shaped pieces would be provided in a thickness allowing for vertical stability on their own, the limited number of connecting pieces and their conformation only allows building planar structures like insulating panels, with short widths, compatible with insulating appliances and not with whole walls and partitions or modular furniture like the blocks in the present invention. Moreover, even though the provided toothed interlocking, female pieces receive the teeth of only one male piece, so there is no interlocking between adjacent female pieces, like in the present invention.

ES2063599 refers to a modular building system with a high resistance to seismic shocks. The system is based on the interconnection of a series of modules of a rectangular prismatic overall shape, in which one of their faces bears projections and the other has complementary depressions for interlocking and immobilizing the different modules together, the assembly thus being based on superposed rows with the modules out of phase with one another to achieve this mutual interconnection; there are corner modules with projections and similar depressions; there are also plates forming the floor structure separating two floors, and modules for forming the upper part or lintel of openings for doors and windows. The mutual interconnection of the various modules, which is made by superposing them in an unsynchronized arrangement, does not require joining components or elements, enabling rapid assembly and disassembly of the building, thus being possible for the modules to be used for another structure. Even though this modular system has interlocking shaped pieces, the provided pieces are not meant to be re-used in a changeable modular assembly, but for building construction instead of the ordinary building bricks which require applying a fixing agent to increase cohesion and blocking the structure. Moreover, the building blocks of ES2063599 are blocked only in the horizontal direction, unlike the present invention whose different male blocks allow interlocking along four different perpendicular directions. Furthermore, according to the present invention, steadiness of the modular assembly relies on the fact that each basic female block is locked by two different male blocks, which strengthens the interlocking of bricks, while in ES2063599 only in some of the complementary blocks there's this same double locking connection. Finally, the elongated form of the basic bricks in ES2063599 requires a strong material to make it resistant, not compatible with light weight materials that would easily break on the middle, unlike the female basic blocks in the present invention.

SUMMARY OF THE INVENTION

The invention relates to interlocking building blocks for changeable modular assemblies, namely for interior walls, floors, furniture or toys, re-usable in an interchangeable mode to build versatile modular assemblies. Nevertheless, further uses can be envisaged, like exterior walls, outdoor furniture or outdoor construction.

These constructive solutions can be interchanged in order to yield new designs. The entire process of assembly and disassembly will be manual without the use of special tools and/or adhesives.

The system consists of flexible interlocking building blocks; it is easily mountable and dismountable without the need of screws, nails, tools, or glues, and is comprised of a set of seven individual parts, each with its own geometric shape, recyclable and reusable, allowing for various combinations to build different building structures and/or furniture. Any structure with a given form (eg. bed) can be easily dismantled and the same parts can be mounted in a different combination for a different type of structure (eg. shelf).

The set of interlocking building blocks of the invention consists of a female block (1) and a set of male blocks (2-5), wherein the female block (1) has rectangular indentations (7) and the male blocks (2-5) fit inside the rectangular indentations (7) of female blocks (1), so that a female block (1) may simultaneously fit in its rectangular indentations (7) two male blocks (2-5), and a male block (2-5) may simultaneously fit inside at least two female blocks (1). In that way, each male block (2-5) simultaneously fills in at least half the rectangular indentations (7) of at least two female blocks (1) and thus fixedly connects said at least two female blocks (1).

The set of interlocking building blocks further comprises a terminal block (6) to fill in empty spaces and provide straight edges on the assembly, and a filling block (11) to extend the assembly eight, width or length.

The female block consists of a semi-hollow cube with a flat bottom face, four side walls with rectangular indentations (7) on their top half, and a rectangular indentation (7) on centre of the top face. The indentations (7) of the female block have a depth equal to half the height of the cube and a width equal to one third of the width of the cube.

The set of male blocks (2-5) comprises male blocks with different configurations, these different configurations allowing the connection of at least two female blocks. Each male block (2-5) fills in half the hollow space of at least two female blocks simultaneously (1). The male block (2-5) can have either two rectangular projections in an I-beam configuration, two rectangular projections at right angles, three projections two of which set up in an I-beam configuration and one at 90 degrees to the I-beam, and four projections at right angles to each other. The filling block (11) is a reflection of the female block (1) along its bottom face, therefore having rectangular indentations on the top and bottom of the piece, and the height of two female blocks.

The terminal block (6), used for filling empty spaces in a module, consists of half a I-beam male block, thus having only one rectangular projection.

By differently combining the female block (1), the male blocks (1-5), the filling block (11) and the terminal block (6) any type of tridimensional modular assembly can be obtained. The modular assembly can be disassembled and re-assembled in a different configuration using the same set of building blocks. Moreover, by further adding wheels to the blocks, the assembly can be easily moved or relocated.

The building blocks are preferably made of a light weight material with good resistance to mechanical loads, preferably a cork-based material, which makes the blocks stackable and vertically stable but reversible and easy-to-handle. Moreover, by preferably using a natural, long-lasting and 100% recyclable raw material like cork or cork-based materials, and through a set of building blocks which can be combined in a completely versatile manner, a simple, flexible, sustainable, and easy-to-use building alternative is provided for interior building and furniture design.

DESCRIPTION OF DRAWINGS

Further characteristics and advantages of the Interlocking building blocks for changeable modular assemblies according to the present invention will be more apparent from the following description of some embodiments thereof, made as a non-limiting examples, with reference to the appended drawings wherein.

Figure 1:
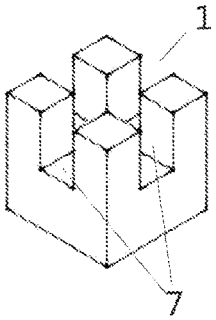
FIG. 1 represents a 3D view of the female block.

2*a* represents an I-beam male block (2) having two rectangular projections (8) linked by a perpendicular web (9), in an I-beam configuration.

2*b* represents a cross-shaped male block (5) consisting of four rectangular projections (8) at right angles with each other, linked by a web (9), said web being cross-shaped and being connected to a rectangular projection (8) in each end.

2*c* represents a T-beam male block (4) consisting of three rectangular projections (8) linked by a web (9), said web being cross-shaped and being connected to a rectangular projection (8) in three of its four ends. Two of the rectangular projections set up in an I-beam configuration and one at 90 degrees to the I-beam.

2*d* represents an L-beam male block (3) consisting of two perpendicular rectangular projections (8) at right angles with each other and linked by a web (9), said web being cross-shaped.

Figure 3:
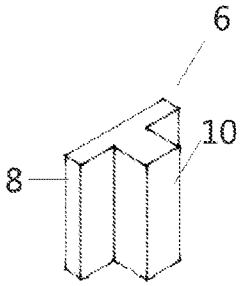

FIG. 3 represents a 3D view of a terminal block (6) consisting of a rectangular projection (8) linked to a perpendicular terminal part (10), which allows filling in empty spaces in female blocks (1) to form straight edges and obtaining an integral structure.

Figure 4:
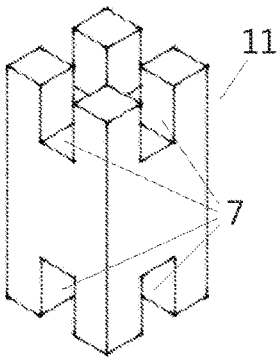

FIG. 4 represents a 3D view of a filling block (11), each filling block being an integral block which is a reflection of the female block (1) along its bottom face, therefore having rectangular indentations on the top and bottom of the piece, and the height of two female blocks.

FIG. 5 represents the method of assembly.

5*a* represents the juxtaposition of female blocks (1) in a linear orientation.

5*b* represents the fitting and interlocking of I-beam male block (2) in the linearly aligned female blocks.

5*c* represents the fitting of a terminal block (6) in the linearly aligned female blocks and interlocked I-beam male blocks.

5*d* represents the fitting and interlocking of filling blocks (11) in the linearly aligned female blocks (1) and I-beam male blocks (2) to extend the module in height and create a wall structure.

5*e* represents the juxtaposition of female blocks (1) in a linear orientation, over the set of linear filling blocks (11) and with its rectangular indentations (7) receiving the rectangular projections (8) of the filling blocks (11), thus finishing this assemblage and creating a wall structure.

Figure 6A:
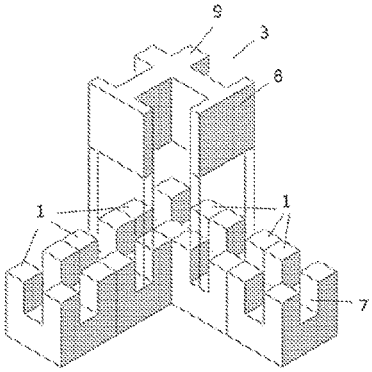
Figure 6B:
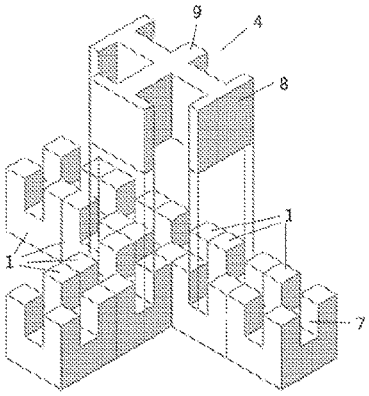
Figure 6C:
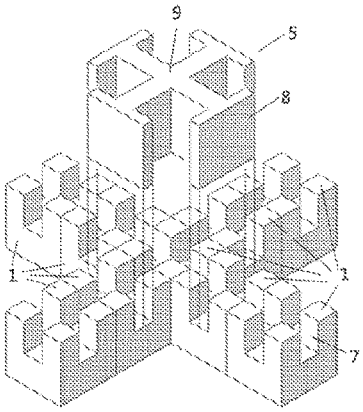
Figure 7A:
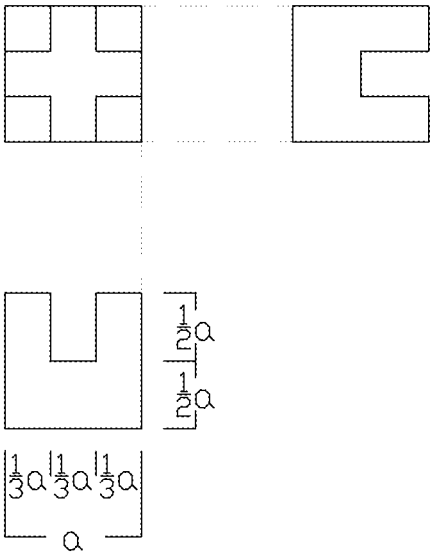
Figure 7B:
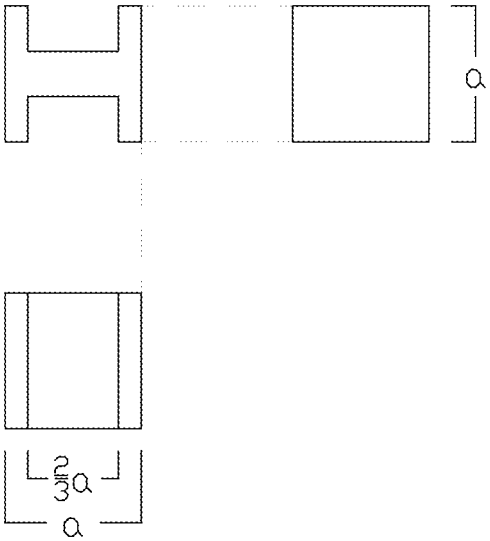
Figure 7C:
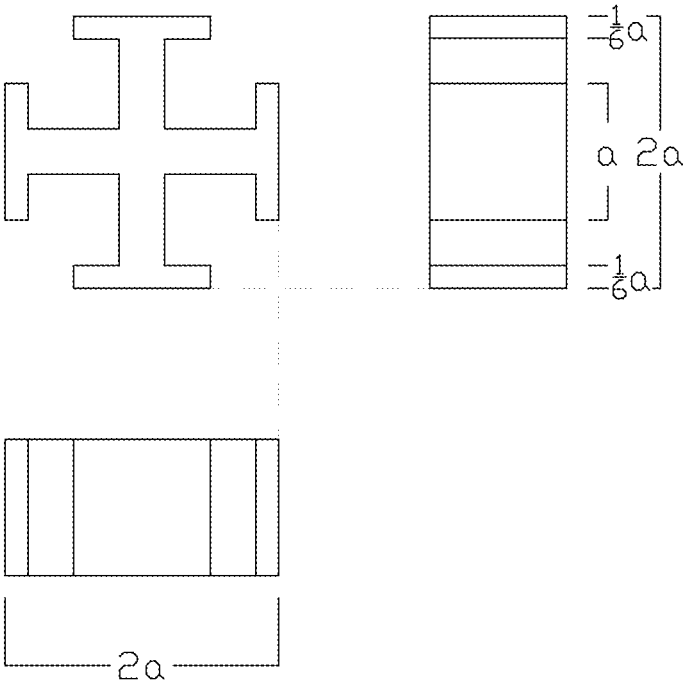
Figure 7D:
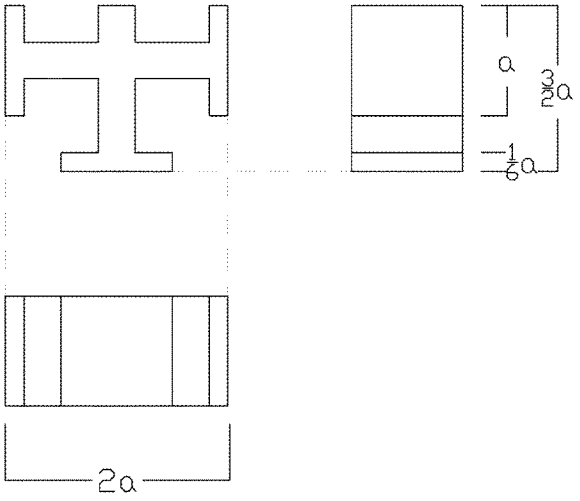
Figure 7E:
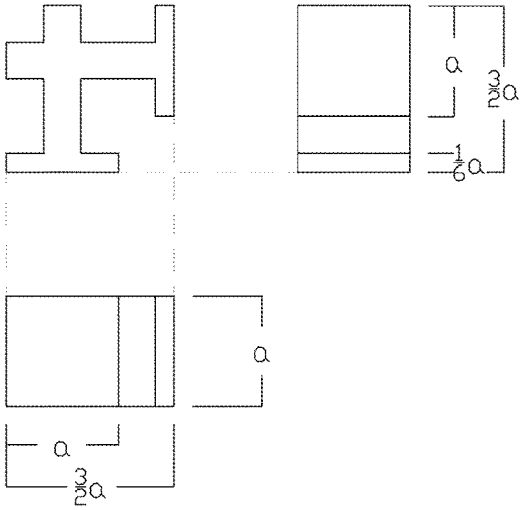
Figure 7F:
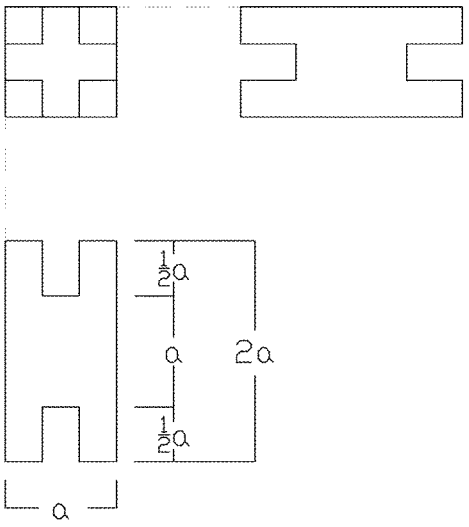
Figure 7G:
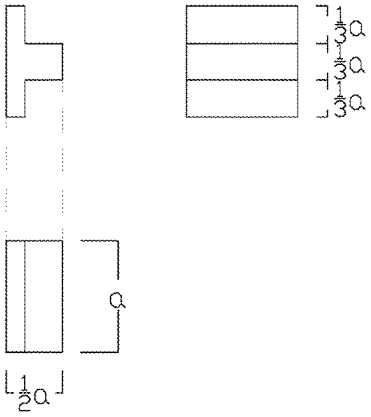

FIG. 6 represents variants in the method of assembly of female blocks (1) with male L-beam male blocks (3), T-beam male blocks (4) and cross-shaped male blocks (5), to form an L-shaped, T-shaped or cross-shaped modular configuration, respectively.

6*a* represents the fitting and interlocking of L-beam male blocks (3) inside the rectangular indentations (7) of two female blocks (1), when each of said two female blocks are juxtaposed to two perpendicular side walls of a third centrally disposed female block (1) in an L-shaped configuration.

6*b* represents the fitting and interlocking of T-beam male blocks (4) inside the rectangular indentations (7) of three female blocks (1), when each of said three female blocks is juxtaposed to a side wall of a centrally disposed female block (1) so that the three female blocks are oriented in a T-shaped configuration.

6*c* represents the fitting and interlocking of cross-shaped male blocks (5) inside the rectangular indentations (7) of four female blocks, when each of said four female blocks (1) is juxtaposed to a side wall of a centrally disposed female block (1) and thus oriented in four different directions in a cross-shaped configuration.

FIG. 7 represents the orthographic view of each of the building blocks in the present invention, representing the proportions between different blocks. The size of the female block cube face (a) can vary between 80 and 700 mm.

7*a* represents orthographic views of a female block.

7*b* represents orthographic views of an I-beam male block.

7*c* represents orthographic views of a cross-shaped male block.

7*d* represents orthographic views of a T-beam male block.

7*e* represents orthographic views of an L-beam male block.

7*f* represents orthographic views of a filling block.

7*g* represents orthographic views of a terminal block.

FIGURE CAPTIONS

1. female block
2. I-beam male block
3. L-beam male block
4. T-beam male block
5. cross-shaped male block
6. terminal block
7. rectangular indentation
8. rectangular projection
9. web
10. terminal part
11. filling block

DETAILED DESCRIPTION OF THE INVENTION

With reference to the above figures, and making reference to the features identified in each figure, a set of interlocking building blocks for changeable modular assemblies is identified in FIGS. 1 to 4. The set of interlocking building blocks has a female block (1) and a set of male blocks (2-5), wherein the female block (1) has rectangular indentations (7) and the male blocks (2-5) fit inside the rectangular indentations (7) of female blocks (1), so that a female block (1) may simultaneously fit in its rectangular indentations (7) two male blocks (2-5), and a male block (2-5) may simultaneously fit inside at least two female blocks (1). In that way, each male block (2-5) simultaneously fills in at least half the rectangular indentations (7) of at least two female blocks (1) and thus fixedly connects said at least two female blocks (1).

In a preferred embodiment, the set of female and male blocks further comprise a terminal block (6), used for filling empty spaces in a module, and a filling block (11) to extend the modular system in height, width or length.

The female block (1) is a semi-hollow cubical block with a bottom and four side walls, with a rectangular indentation (7) in each of its four side walls and one rectangular indentation (7) at the centre of the cube volume, each indentation having a depth which is half the height of the cube wall and a width which is one third of the width of the cube sidewall. In a preferred embodiment, the cubic female blocks measure between 80 and 700 mm, and more preferably, between 190 mm and 700 mm, in all its sides.

The male blocks (2-5) are symmetrically built along at least one of their axis. Each male block has at least two rectangular projections (8) linked by a web (9), and said rectangular projections (8) and said web (9) have twice the height of the indentations (7) of a female block (1), so that when a male block (2-5) fits inside at least two female blocks (1), half the eight of the rectangular projections (8) and half the height of the web (9) of said male block (2-5) is inside the at least two female blocks (1), and a symmetrical portion extends outside the top surface of the female blocks (2). This results in the possibility of fitting the symmetrical part extending outside the top surface of the female block inside a second pair of female blocks.

The set of male blocks (2-5) comprises male blocks with different conformations, those different conformations allowing the connection of at least two female blocks. Each male block has at least two rectangular projections (8) which fit in the rectangular indentations (7) of female blocks, said projections having two square opposing surfaces with the same height as the female blocks and two rectangular opposing surfaces whose height is the same as the female blocks and whose width is half the width of a rectangular indentation (7) of a female block (1). Due to this complementarities and dimensions, when fitting inside a rectangular indention (7) of a female block, each rectangular projection (8) fills in half the hollow space of the rectangular indentation (7) at the centre of the female block (1) and half the hollow space of the rectangular indentations in two opposite side walls of a female block (1).

In a preferred embodiment, the set of male blocks comprises four different types of male blocks, each male block having two (FIGS. 2*a* and 2*d*), three (FIG. 2*c*) or four (FIG. 2*b*) rectangular projections (8) which simultaneously fit inside two, three, four or five female blocks (1), like shown in FIGS. 5 and 6.

Figure 2A:
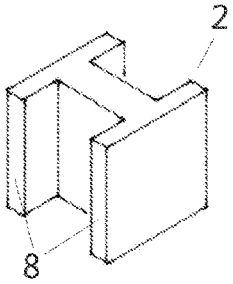
FIG. 2 represents a 3D view of the set of male blocks.

In a more preferred embodiment, a male block has an I-beam configuration (2), like the one described in FIG. 2*a*, consisting of two opposite rectangular projections (8) linked by a web (9) in an I-beam configuration. The web (9) is a linear connecting part whose width equals two thirds the female block (1) width. Therefore, the I-beam male block (2) simultaneously fits inside two female blocks (1) such that each half of the I-beam male block (2), regarding its line of symmetry, simultaneously fills in half the hollow space of two linearly disposed female blocks (1), like shown in FIG. 5. The I-beam male block (2) has a web (9) which is perpendicular to rectangular projections (8), has the same height as the rectangular projections (8), extends between rectangular projections (8) along a length which is two-thirds of the width of the female sidewall and has a width which is one-third of the width of the female sidewall.

Figure 2B:
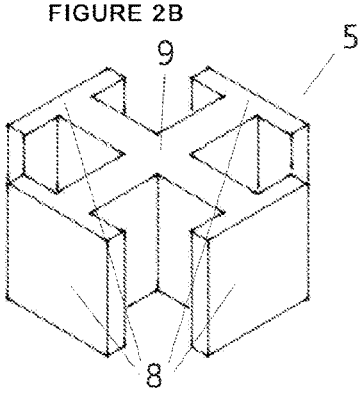

In another more preferred embodiment, a male block has a cross-shaped configuration, like the one described in FIG. 2*b*. This cross-shaped male block (5) consists of four rectangular projections (8) at right angles with each other and linked by a web (9). In this cross-shaped configuration, the web is cross-shaped and connects to a rectangular projection (8) in each of its arms, so that the rectangular projections (8) are opposite and parallel two-by-two. According to this configuration, the rectangular projections (8) of said cross-shaped male block (5) simultaneously fits inside the rectangular indentations (7) of five female blocks, so that when four female blocks (1) are juxtaposed to a different side wall of a centrally disposed fifth female block (1) in a cross-shaped configuration, said rectangular projections (8) and said web (9) simultaneously fill in half the hollow space of said four female blocks (1) and the whole hollow space of the said centrally disposed fifth female block (1), like illustrated in FIG. 6*c*.

Figure 2C:
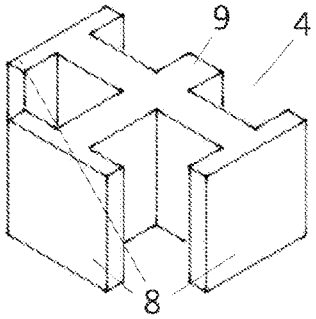

In another more preferred embodiment, a T-beam male block (4), like the one described in FIG. 2*c*, consists of three rectangular projections (8) linked by a web (9). In this configuration, the web is cross-shaped and connects to a rectangular projection (8) in three of its four ends, two of the rectangular projections setting up in an I-beam configuration and one at 90 degrees to the I-beam so that said T-beam male block (4). The T-beam male block (4) is able to simultaneously fit inside four female blocks (1) so that when three female blocks (1) are juxtaposed to a different side wall of a centrally disposed fourth female block (1) in a T-shaped configuration, said rectangular projections (8) and said web (9) simultaneously fills in half the hollow space of said three female blocks (1) and the whole hollow space of the said centrally disposed fourth female block (1).

Figure 2D:
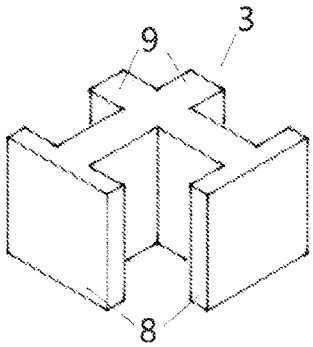

In yet another more preferred embodiment, an L-beam male block configuration (3), like the one described in FIG. 2*d*, consists of two perpendicular rectangular projections (8) at right angles with each other and linked by a web (9), said web being cross-shaped. The L-beam male block (3) is thus able to simultaneously fit inside three female blocks (1) so that when two female blocks (1) are juxtaposed to two perpendicular side walls of a third centrally disposed female block (1) in an L-shaped configuration, said rectangular projections (8) and said web (9) simultaneously fill in half the hollow space of said two female blocks (1) and the whole hollow space of the said centrally disposed female block (1).

In a preferred embodiment, the set of female and male blocks further comprise a terminal block (6) to fill in empty spaces in female blocks (1), consisting of a rectangular projection (8) linked to a perpendicular terminal part (10), corresponding to half an I-beam male block, like the one represented in FIG. 3. The combined width of said terminal part (10) and said rectangular projection (8) correspond to half the width of a female block sidewall, and the height of either said rectangular projection (8) or said terminal part (10) are equal to the height of a female block (1) sidewall, so that each terminal block (6) can fill in half the hollow space of a female block and a symmetrical part extending outside the top surface of said female block (1) can fill in half the hollow space of a second female block (1), said two female blocks (1) having their top faces facing each other. The terminal block (6) is used for filling empty spaces and allows a complete finishing to the modular structure.

Figure 5A:
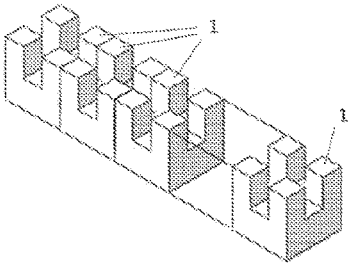
Figure 5B:
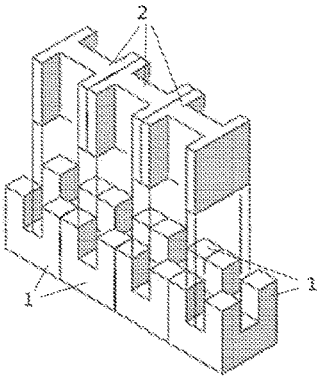
Figure 5C:
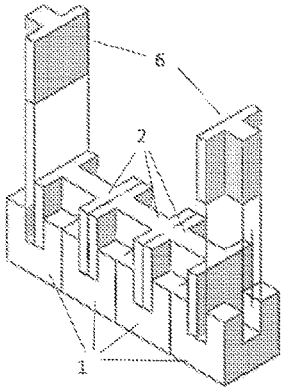
Figure 5D:
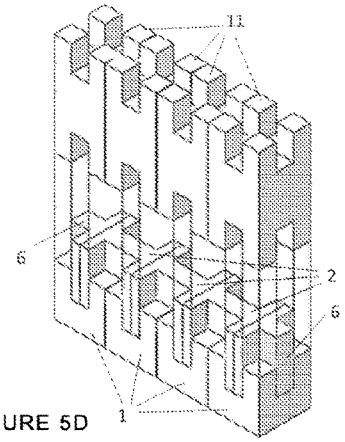
Figure 5E:
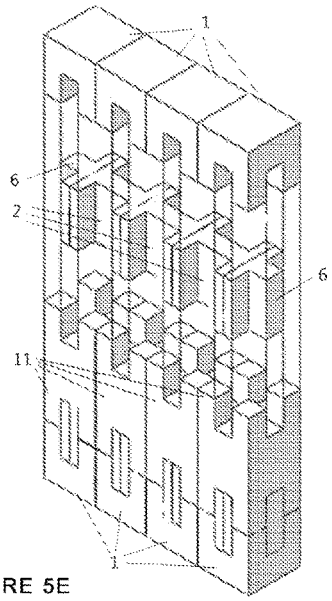

In another preferred embodiment, the set of female and male blocks further comprise a filling block (11) to extend the modular system in height, width or length, like exemplified in FIG. 5*d-e*. Each filling block (11) is a reflection of the female block (1) along its bottom face, therefore having rectangular indentations (7) on the top and bottom of the piece. The height of a filling block (11) equals two female blocks. The rectangular projections (8) of male blocks (2-5) can thus fit in the rectangular indentations (7) on both sides of the filling blocks (11) and a male block (2-5) may simultaneously fit inside at least two filling blocks (11), each male block (2-5) filling in half the rectangular indentations (7) of at least two filling blocks (11) and thus fixedly connecting said at least two filling blocks (1).

The set of building blocks of the invention is made of a material suitable for the type of modular construction in which the blocks are to be used. In a preferred embodiment, the blocks are made of a light weight material with good resistance to mechanical loads, which makes the blocks stackable and vertically stable but also easy to handle and take apart, preferably cork-based materials, more preferably pressed cork, more preferably pressed cork resulting in blocks weighting between 100 Kg/m3 to 200 Kg/m3, therefore making the blocks suitable for in house building and decoration, particularly for interior walls and furniture. A light weight material with good resistance to mechanical loads makes the blocks stackable and vertically stable but reversible and easy-to-handle.

In another preferred embodiment, are made of a building material suitable for large scale construction, like cement, concrete, clay or other pressed materials, therefore making the blocks suitable for large scale outdoor construction works.

The blocks are sized accordingly with the type of modular construction in which the blocks are to be used, either for small scale and large scale applications. In a preferred embodiment, the cubic female blocks (1) measure between 80 mm and 700 mm in all its sides, and more preferably between 190 mm and 700 mm in all its sides.

Furthermore, the blocks of the present invention may further have wheels to allow modular assemblies to be easily moved or relocated.

The present invention also refers to a method for building changeable modular assemblies which are vertically stable characterized by the combination of the building blocks, wherein at least one female block (1) is used as basic construction unit; at least one male block (2-5) is used to interconnect female blocks in a linear, L-shaped, T-shaped, or cross-shaped arrangement; at least one filling block (11) is used between male blocks to increase modular panel width, length or height; female blocks, male blocks and filling blocks are interconnected in any desired orientation until a desirable length, width and height of the modular assembly is achieved; at least one terminal block (6) is used to fit in at least one female block (1) and fill in empty spaces in the extremities of the assembly to form a straight edge; and by differently combining the female block (1), the male blocks (1-5), the filling block (11) and the terminal block (6), any type of tridimensional modular assembly can be obtained. This method allows disassembling and re-assembling any structure in a different configuration using the same set of building blocks.

The blocks of the invention have internal and external finishes that are complete. Thus, after construction of a structure, there is no additional need to fill in spaces, paint, hang wallpaper or otherwise treat the outer and inner walls of the final structure to keep it stable.

Several modular systems for building walls or furniture have been created so far, none of the existing modules nevertheless allowing for an easy-to-lock changeable modular assembly combined with an interlocking system which guarantees the stability of the modular structure and that it does not get out of plumb with increased height. The strength of the interlocking mechanism of the present invention relies on the semi-hollow cubical structure of the female blocks (1) and filling blocks (11) and on its rectangular indentations (7) having a depth which is half the height of the cube wall and a width which is one third of the width of the cube sidewall, combined with the male-female fitting properties of the building system. Because a female block (1) may simultaneously fit in its rectangular indentations (7) two male blocks (2-5), and the size of the male blocks is such that when they fit inside at least two female blocks (1), half the eight of the rectangular projections (8) and half the height of the web (9) of said male blocks (2-5) is inside the at least two female blocks (1), and a symmetrical portion extends outside the top surface of the female blocks (2) and can fit inside another at least two female blocks (1), and thus fixedly connect said at least two female blocks (1).

The proportion of the indentions relative to the whole body of the blocks, along with the multiple fitting of the male parts of this locking system thus provides a robust support for the successive stacking, without putting too much tension on the locking projections of the male blocks (2-5) and guaranteeing the vertical stability with increased height, unlike the traditional modular systems.

Although different building materials can be used according to different construction uses, light weighted materials make the blocks of the invention perfectly adapted for interior design in a do-it-yourself basis, easy to assemble, with no tools, no screws and no glues, and in a completely dynamic and interchangeable manner, easily mounting and dismounting the modular structure.

The invention offers the possibility for any person to dynamically create walls, divisions in open spaces, shelves, beds, tables, chairs, and almost all kinds of furniture to be used in any home, office, garden, or public building. Furthermore, it allows the construction of floating devices.

Several lightweight materials can be used to obtain the building blocks of the invention. Nevertheless, by preferably using cork or cork-based materials, desirable strength and stability in vertical stacking is combined with versatility and with the well known properties of the cork, like soundproofing, thermic isolation, impermeability, buoyancy, elasticity, fire retardant, antimicrobial effects, aesthetic characteristics and easy to clean.

Moreover, by using a natural, long-lasting and 100% recyclable raw material, and through a set of building blocks which can be combined in a completely versatile manner as many times has you like, a sustainable and eco-friendly building alternative is provided particularly for interior building and furniture design.

By differently combining the seven blocks of the invention in an easy, dynamic and renewable way, no additional tools or fixing means are required in order to build all kinds and sizes of tridimensional structures.

The invention claimed is:

1. An interlocking system of one or more female building blocks and a set of male building blocks that engage forming unique, solid, strong and vertically and horizontally stable structures that are fit to be used as changeable modular assemblies such as interior walls, floors, furniture, exterior walls, outdoor furniture or outdoor construction, comprising: the one or more female building blocks (1) each comprising a semi-hollow cubical block with a flat bottom face and four side walls having one rectangular indentation (7) in each side wall, said indentations (7) having a depth equal to half the height of the cubical block and width equal to one third of the width of the cubical block; and the set of male building blocks (2-5) comprising one or more of each of four different types of male building blocks, the types of the set of male building blocks comprising two, three, or four rectangular projections (8) linked by a unique and solid interconnecting structure composed by one or two webs (9), wherein said rectangular projections (8) and said one or two webs (9) have twice the height of the indentations (7); wherein engagement of the one or more of each of the four different types of male building blocks with the one or more female building blocks in one or both axis without tools or glue provides structural strength and stability to the changeable modular assemblies;

wherein a third type of the four different types of male building blocks (4) consists of three said rectangular projections (8) arranged on three sides of a square and linked by two of said one or two webs (9), said two of one or two webs (9) connected perpendicularly to one another to form a cross-shaped structure wherein two opposite ends of one of the two of one or two webs (9) and one end of the other of the two of one or two webs (9) are each connected to one of the three rectangular projections (8), wherein said third type of the four different types of male building blocks (4) is configured to engage with four of the one or more female building blocks (1); and wherein a fourth type of the four different types of male building blocks (3) consists of two said rectangular projections (8) arranged on two adjacent sides of a square and linked by two of said one or two webs (9), said two of one or two webs (9) connected perpendicularly to one another to form a cross-shaped structure wherein one end of each of the two of one or two webs (9) is connected to one of the two rectangular projections (8), wherein said fourth type of the four different types of male building blocks (3) out of the four different types of male building blocks is configured to engage with three of the one or more female building blocks (1).

2. The interlocking system of claim 1, wherein a one of the male building blocks of the set of male building blocks (2-5) comprising two, three or four rectangular projections (8) which can simultaneously fit inside two, three, four or five female building blocks, fits inside at least two of the one or more female building blocks (1), and half the height of the rectangular projections (8) and half the height of one of the said one or two webs (9) of said male building block (2-5) is inside the at least two female building blocks (1), and a symmetrical portion extends outside the top surface of the female building blocks (2), such that said symmetrical portion extending outside the top surface of the female building blocks (1) can fit inside another at least two female building blocks (1).

3. The interlocking system of claim 1, wherein a first type of the four different types of male building blocks (2) consists of two said rectangular projections (8) linked by one of said one or two webs (9) disposed between the two rectangular projections (8), wherein the first type of the four different types of male building blocks (2) is configured to engage with two of the one or more female building blocks (1).

4. The interlocking building blocks of claim 3, wherein the one web (9) has a length which is two-thirds of the width of the cubical block.

5. The interlocking system of claim 1, wherein a second type of the four different types of male building blocks (5) consists of four said rectangular projections (8) arranged on four sides of a square and linked by two of said one or two webs (9), said two of one or two webs (9) connected perpendicularly to one another to form a cross-shaped structure wherein each end of the two of one or two webs (9) is connected to one of the four rectangular projections (8), wherein said second type of the four different types of blocks (5) is configured to engage with five of the one or more female building blocks (1).

6. The interlocking system of claim 1, further comprising a terminal block (6) consisting of an additional rectangular projection (8) the same shape as the rectangular projections of the set of male building blocks, linked to a terminal part (10), wherein a dimension of said terminal part (10) measured perpendicular to the additional rectangular projection (8) combined with the width of the said rectangular projections (8) is equal to half the width of the cubical block, and the height of the additional rectangular projection (8) and terminal part (10) is the same as the height of the cubical block.

7. The interlocking system of claim 1 further comprising a filling block (11) the same shape as two of the one or more female building blocks (1) arranged having the flat bottom faces disposed in contact with one another.

8. The interlocking system of claim 1, wherein the interlocking building blocks are made of cork, cork-based materials or other material suitable for the type of modular construction in which the blocks are to be used.

9. The interlocking system of claim 1, wherein the interlocking building blocks are made of a lightweight material comprising good resistance to mechanical loads, and having a mass density in the range of 100 $Kg/m^3$ to 200 $Kg/m^3$.

10. The interlocking system of claim 1, wherein each side wall of the one or more female blocks measures in a range of 80 mm to 700 mm.

* * * * *